United States Patent [19]

Fritz et al.

[11] 4,033,083

[45] July 5, 1977

[54] BACK FASTENING OF MOBILE HOME CEILING BOARDS

[75] Inventors: Thomas W. Fritz, East Petersburg; Charles F. Gilbo, Lancaster; Norman A. Johnson, Lititz, all of Pa.

[73] Assignee: Armstrong Cork Company, Lancaster, Pa.

[22] Filed: Mar. 29, 1976

[21] Appl. No.: 672,547

Related U.S. Application Data

[63] Continuation of Ser. No. 267,431, June 29, 1972, abandoned.

[52] U.S. Cl. ..... 52/484; 52/357; 52/511; 52/385

[51] Int. Cl.[2] ..... E04B 5/52

[58] Field of Search ..... 52/361–363, 52/357, 470, 471, 586, 487, 474, 511, 512, 391, 385, 489

[56] References Cited

UNITED STATES PATENTS

| | | | |
|---|---|---|---|
| 239,846 | 4/1881 | Ring | 52/512 |
| 325,009 | 8/1885 | Peterson | 52/391 |
| 1,012,961 | 12/1911 | Abarno | 52/713 |
| 1,728,231 | 9/1929 | Denk | 52/713 |
| 1,778,412 | 10/1930 | Balduf | 52/144 |
| 2,013,101 | 9/1935 | Inglee | 52/713 |
| 2,024,068 | 12/1935 | Shannon | 52/362 |
| 2,084,544 | 6/1937 | Wilson | 52/466 |
| 2,132,499 | 10/1938 | Tuthill | 52/391 |
| 2,742,778 | 4/1956 | Olmstead | 52/713 |
| 3,005,293 | 10/1961 | Hunter | 52/712 |
| 3,020,602 | 2/1962 | Siering | 52/363 |
| 3,123,389 | 3/1964 | Biesecker | 287/20.92 C |
| 3,298,147 | 1/1967 | Haberman | 52/714 |
| 3,745,734 | 7/1973 | Davey | 52/471 |

FOREIGN PATENTS OR APPLICATIONS

| | | | |
|---|---|---|---|
| 223,222 | 11/1958 | Australia | 52/144 |
| 220,561 | 3/1959 | Australia | 52/385 |
| 561,466 | 10/1957 | Belgium | 52/385 |
| 391,854 | 11/1908 | France | 52/391 |
| 662,944 | 8/1929 | France | 52/391 |
| 1,229,470 | 10/1960 | France | 52/713 |
| 87,704 | 8/1896 | Germany | 52/391 |
| 606,483 | 8/1948 | United Kingdom | 52/713 |

*Primary Examiner*—Price C. Faw, Jr.
*Assistant Examiner*—Henry Raduazo

[57] ABSTRACT

Mobile home ceiling boards are normally made in 4-foot-wide sheets which are fastened to the ceiling roof trusses at 16-inch intervals. Herein are shown at least three separate ways of fastening the ceiling board to the roof trusses by the use of a fastening means which engages the back of the ceiling board and is fastened to a roof truss member. This permits the utilization of a concealed fastening structure for fastening the large ceiling boards to the roof trusses of a mobile home ceiling or any other conventional ceiling structure. Each of the three fastening techniques involves the use of cuts in the ceiling board which receive the flanges of a fastening structure. This structure can be previously attached to the roof truss or installed in the board cuts before attaching to the roof truss. A combination system could also be used wherein a part inserted in the board cuts would mate with a part previously attached to the roof truss.

1 Claim, 5 Drawing Figures

Fig. I
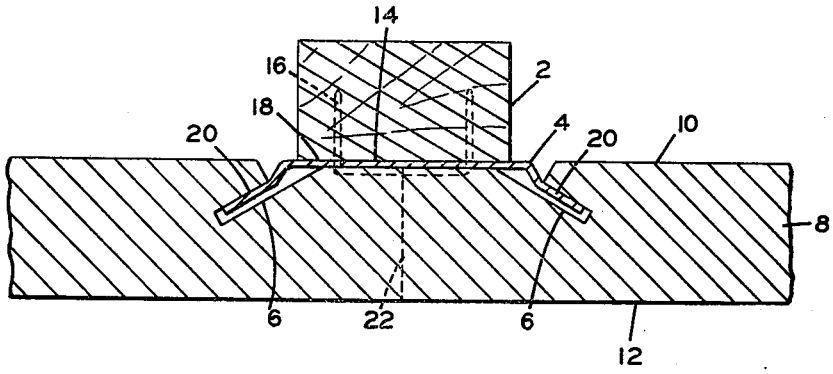
Fig. II
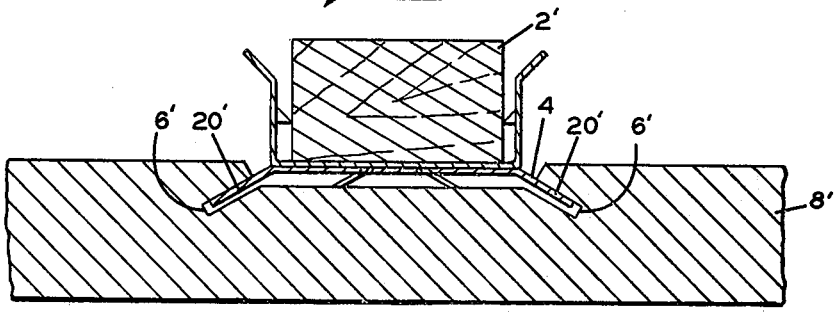
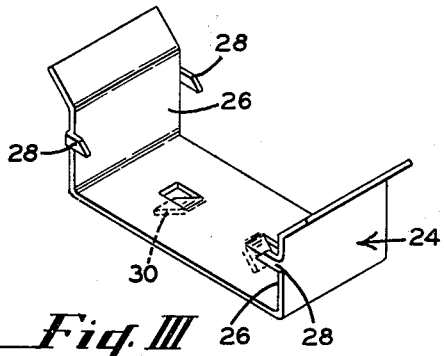
Fig. III
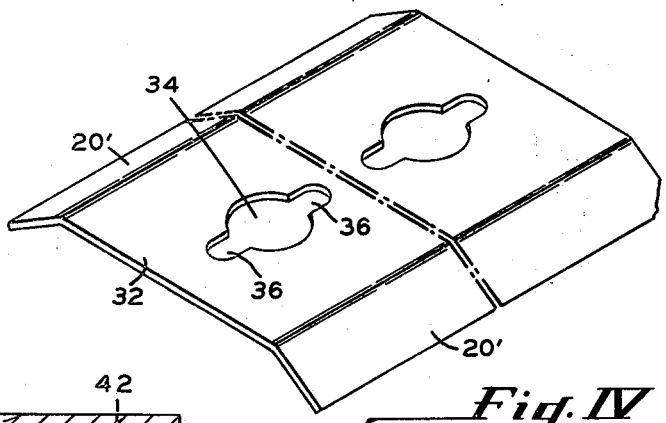
Fig. IV
Fig. V
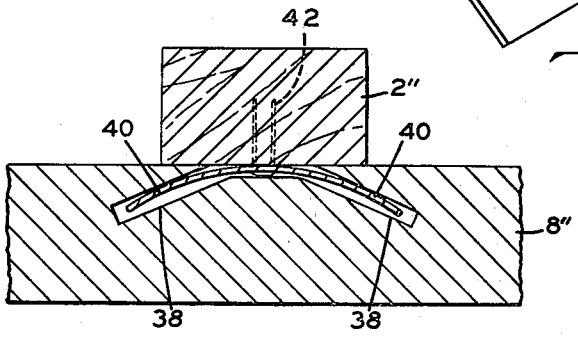

BACK FASTENING OF MOBILE HOME CEILING BOARDS

This is a continuation of application Ser. No. 267,431, filed June 29, 1972, and now abandoned.

BACKGROUND OF THE INVENTION

1. Field of the Invention

The invention is directed to a ceiling suspension system and, more particularly, to a concealed fastening technique for mobile home ceilings.

2. Description of the Prior Art

Historically, the mobile home industry has preferred the use of large boards for the ceiling structures of their mobile home structures. Normally, this means the utilization of a 4-foot-wide board which may vary in length from 10 feet to 14 feet. This board is fastened to overlying roof truss structures which are positioned at 16-inch intervals. Therefore, each ceiling board would be fastened to four roof trusses, two at each edge of the board, and two in the mid-region of the 4-foot-wide board.

Initially, ceiling boards were mounted in place by driving nails through the front face of the ceiling board into the roof truss and using rosettes to conceal the nail heads. On other occasions, staples would be used to fasten the ceiling boards in position, and a batten strip would be placed over the staples to conceal the staples. This resulted in a spaced series of batten strips extending across the width of the ceiling structure.

Finally, the art advanced to the use of a stapling groove wherein the board is provided with a groove into which staples are passed. A plastic strip is then placed overtop of the staples to conceal the staples. This plastic strip could either act as an accent for the board at 16-inch intervals, or the strip could be finished off to blend in with the board structure to attempt to provide a uniform board structure. However, the blending in never was fully accomplished, and it was always obvious that there was some type of structure every 16 inches apart on the ceiling board.

The ideal situation in a mobile home structure would be to simulate a conventional home ceiling wherein the ceiling appears as a single unitary structure. The techniques to be disclosed hereinafter provide a means of approaching almost the ideal ceiling structure.

SUMMARY OF THE INVENTION

Three embodiments are shown herein. Each embodiment involves the basic principle of providing a slot structure in the back side of a ceiling board. Into the slot structure there is placed a flange means which has its main body fastened to the overlying roof trusses or joists of a ceiling structure. Consequently, the ceiling board is held in position by a positive engagement structure, and there is no evidence on the front side of the board of the existence of a fastening means holding the ceiling board in position. Consequently, when a large number of 4-foot-wide boards are mounted in a room, the only discontinuity that prevents the appearance of an overall continuous ceiling system is the presence of a thin line every 4 feet where adjacent ceiling boards abut each other. These joints could be concealed by other methods.

In each embodiment shown, some means such as a staple or clamp is used to secure a fastening means to the overlying ceiling joists. On this fastening means there is a positioned flange means which will engage cuts in the underlying ceiling board. The cuts are placed in the board at a small angle relative to the plane of the back side of the ceiling board. This then permits the flange means to be engaged in the cuts and to provide a supporting action to the ceiling board.

BRIEF DESCRIPTION OF THE DRAWING

FIG. I is an end view of one modification of the invention herein;

FIG. II is an end view of another modification of the invention herein;

FIGS. III and IV are separate views of the two component parts forming the fastening means utilized in the embodiment of FIG. II; and FIG. V is another embodiment of the invention herein.

DESCRIPTION OF THE PREFERRED EMBODIMENTS

In all three embodiments which are shown in FIGS. I, II and V, there are two basic parts to the fastening means for holding ceiling boards in position relative to a ceiling structural member. The first part is some type of fastening means with a flange means. This fastening means is connected to the members of the structural ceiling. The second part of the fastening structure is a slot means within the ceiling board for receiving the flange means of the fastening means. The engagement of the flange means within the slot means holds the ceiling board relative to the structural ceiling members.

In FIG. I, there is shown a fastening means structure which is very similar in configuration to that shown in U.S. patent application Ser. No. 153,508, entitled "Joint Construction for Ceiling Panels," wherein there is shown a plastic strip for concealing the stapling area of a ceiling board. Normally, the plastic strip would be utilized on the front of the ceiling board to conceal the area wherein the staples are placed to fasten the ceiling board to the overlying structural member of the ceiling. In FIG. I, there is shown as element 2 a ceiling joist or the lower chord member of a roof truss. The back fastening structure is composed of the fastening means 4 and the slot means 6. A ceiling board 8 is provided with the back surface 10 and the front surface 12 which will be visible to people within the room covered by the ceiling structure. The fastening means 4 has a center region 14 which is relatively flat and which is held by staples 16 in position against the lower portion 18 of the roof joist 2. Flange means 20 are provided on either side of the fastening means 4. These means 20 pass into the slot means 6 of the ceiling board. The ceiling board is now held in position relative to the joist 2, and the weight of the ceiling board can be readily carried through the engagement of the flange means 20 with the inside of the slot means 6.

A fastening means 4 will extend the full length of the joist 2, and the joist 2 will extend the full width of the room structure. Joists are provided normally every 16 inches on center and, therefore, the board will be supported every 16 inches for the full length of the board. Every 4 feet there will be a joint structure between two adjacent 4-foot boards, and the joint structure would simply be an abutting line such as that shown in FIG. I as dotted line 22. At the joint, each edge of the board would be provided with one-half of the slot means shown in FIG. I.

In FIG. II, there is shown a second embodiment of the back fastening invention herein. In the FIG. II showing, the joist 2′ is the same as that shown in FIG. I, and the board 8′ is the same as that of the FIG. I showing. The fastening means 4′ is a resilient clip-like structure which engages the side walls of the joist 2′, and this holds the fastening means 4′ in place. The fastening means 4′ is provided with flange means 20′ which engage slot means 6′ in the ceiling board 8′.

FIGS. III and IV are perspective views of the two-part structure which forms the fastening means 4′ of the FIG. II embodiment. FIG. III is a perspective view of the clip structure 24 which has resilient sides 26. These sides have tangs 28 which engage the side of the joist 2′. The combination of the resilient pressure of the sides 26 and the tangs engaging the sides of the joist will hold the clip 24 in position relative to the joist 2′. The clip is provided with two partially cut-out tabs 30 which are bent downward from the bottom of the clip and face away from each other.

In FIG. IV, there is shown the second part of the fastening means 4′ of FIG. II wherein the flange means 20′ are connected together by a plate 32. Within the plate 32, there are a series of cut-outs 34. The cut-outs are so shaped so that the tabs 30 of the clip member 24 may be inserted into the elongated cuts 36 of the cut-out 34. The clip is then rotated 90 degrees relative to the plane of plate 32 so that the clip is now engaged with the plate 32. A plurality of clips may be placed along the plate 32 with the number of clips being determined by the weight of the ceiling board. When the structures of FIGS. III and IV are assembled together, they will appear in cross section as the fastening means 4′ of the FIG. II showing. Naturally the structure of FIG. II could be made as an integral structure. Also the fastening means could be made a series of short pieces rather than one long piece extending along the length of the slot means.

In FIG. V, there is shown still another embodiment of the invention herein. There is provided the joist structure 2″ and the board structure 8″. Slot means 38 are provided in the board structure 8″, but they are of a slightly different spacing and configuration from that shown in the embodiments of FIGS. I and II. The flange means 40 which would be comparable to the flange means 20 and 20′ of the other embodiments is actually part of the end of a conventional venetian blind slat which would be normally concave in shape. A staple 42 is placed in the center of the venetian blind structure to hold the venetian blind relative to the joist 2″. The flange means 40 readily engages the slot means 38 to hold the board 8″ in position relative to the joist2″.

With the above structure, it is possible to secure the fastening means onto the roof truss of a mobile home or the joists of any conventional ceiling structure before the ceiling is actually put in place or even after the ceiling has been installed. Particularly in a mobile home structure, the ceiling board will then be slid over the flange means of the fastening means so that the flange means will engage the slot means within the ceiling board. It will be very easy to slide the flange means from one end of the board to the other end of the board along the slot means. A conventional 4-foot by 12-foot ceiling board would be held in place by four fastening means which would be approximately 12 feet long and spaced 16 inches on center. This will provide more than adequate support to hold the ceiling board in position, and the ceiling board will now be held in position with no visible fastening means on the front side of the ceiling board. By carefully positioning a series of adjacent ceiling boards in a very close abutting relationship, the installed ceiling system will appear to be a uniform continuous ceiling system. It certainly will not have the distracting batten strips, rosettes or staple concealing strips every 16 inches, which are now conventional in the art.

What is claimed is:

1. A back fastening means for fastening a ceiling board to overlying structural ceiling members wherein the ceiling board has a back surface and a front surface which is visible to view and both surfaces are in a horizontal plane, slot means are provided in the back surface of the ceiling board at spaced intervals along the ceiling board, said slot means in the ceiling board are at least two oppositely directed, outwardly extending cuts within the ceiling board at a small angle relative to the plane of the back surface of the ceiling board and spaced from the back corners of the ceiling board, and fastening means are connected to the overlying structural ceiling members, said fastening means in a resilient spring clamp means which engages the sides of a joist which constitutes the overlying structural ceiling members, said clamp holding the fastening means in position relative to the joist, said fastening means having outwardly extending flange means which are positioned so that the flange means are inserted into the slot means and are slideably movable along the slot means of the ceiling board, thereby holding the ceiling board in position relative to the structural members of the ceiling and permitting the ceiling board to be moved relative to the fastening means, said flange means extending outwardly from the lower corners of the clamp means, and said clamp means further being a separate component from the flange means and said flange means being releasably connected to the clamp means.

* * * * *